US005682846A

United States Patent [19]

Scharnweber

[11] Patent Number: 5,682,846

[45] Date of Patent: Nov. 4, 1997

[54] ENGINE VALVE ACTUATOR WITH DIFFERENTIAL AREA PISTONS

[75] Inventor: David H. Scharnweber, White Lake, Mich.

[73] Assignee: Eaton Corporation, Cleveland, Ohio

[21] Appl. No.: 772,037

[22] Filed: Dec. 19, 1996

[51] Int. Cl.[6] ..... F01L 9/02

[52] U.S. Cl. ..... 123/90.12

[58] Field of Search ..... 123/90.11, 90.12, 123/90.13, 90.14, 90.15

[56] References Cited

U.S. PATENT DOCUMENTS

| | | | |
|---|---|---|---|
| 3,209,737 | 10/1965 | Omotehara et al. | 123/90.12 |
| 5,193,495 | 3/1993 | Wood, III | 123/90.12 |
| 5,529,030 | 6/1996 | Rose | 123/90.12 |
| 5,582,141 | 12/1996 | Meyer | 123/90.12 |
| 5,595,148 | 1/1997 | Letsche et al. | 123/90.12 |

*Primary Examiner*—Weilun Lo

*Attorney, Agent, or Firm*—Loren H. Uthoff, Jr.

[57] ABSTRACT

A high pressure fluid is used to power an actuator for opening and closing an engine poppet valve when the actuator has a valve stem supporting an upper piston and an adjacent lower piston which axially transverse an actuator housing in response to the flow of high pressure fluid as determined by the position of a control valve. The upper piston has a larger diameter than the lower piston which has a larger diameter than the valve stem. An upper chamber is defined by the upper piston and the actuator housing while a lower chamber is defined by an outside peripheral surface of the lower piston and the actuator housing.

5 Claims, 2 Drawing Sheets

ENGINE VALVE ACTUATOR WITH DIFFERENTIAL AREA PISTONS

BACKGROUND OF THE INVENTION

The present invention relates to a fluid powered actuator for opening and closing an engine valve. More specifically, the present invention relates to a fluid powered actuator for opening and closing an engine valve using an actuator piston having differential effective areas for opening and closing.

Prior art actuators use a piston attached to the top of the stem of an engine intake or exhaust valve such that high pressure fluid introduced into the area both above and below the actuator piston causes the valve to open due to an area differential where the effective cross-sectional area of the bottom side of the actuator piston is reduced by the valve stem cross-sectional area. Thus, the top side of the actuator piston area exceeds the bottom side of the actuator piston area by the cross-sectional area of the engine valve stem. Thus, the effective opening area against which the high pressure fluid operates is the valve stem area. Actuators to date have used the valve stem to define the lower cross-sectional area and thus the effective closing area differential between the top and bottom of the actuator piston. With a specific valve stem, the piston diameter is calculated to achieve the desired differential area.

U.S. Pat. Nos. 4,200,067; 5,255,641; 5,448,973; 5,507,316 and 5,509,637, the disclosures of which are hereby incorporated by reference, disclose valve actuators which use high pressure hydraulic oil applied to both the top and bottom of a piston attached to a valve stem to open an engine valve. The differential area between the top and bottom of the piston due to the valve stem results in an unbalanced force to move the valve open when high pressure fluid is introduced into an upper chamber and the valve closes when the high pressure fluid is vented from the upper chamber. The differential area is created since the valve stem exists only from the bottom of the piston.

SUMMARY OF THE INVENTION

The present invention provides for improved performance of a fluid powered engine valve actuator by using two adjacent pistons; an upper piston having a larger diameter than a lower piston. The upper and lower pistons are attached to the engine valve stem where the lower piston traverses a lower chamber that always contains high pressure fluid and the upper piston traverses an upper chamber wherein the fluid pressure is varied according to the desired motion of the valve. High pressure fluid is introduced into the upper chamber through a control valve and acts against the upper piston which has a larger diameter and effective area than the lower piston resulting in a force unbalance to open the engine valve. To close the engine valve, the upper chamber is vented through the control valve and the high pressure fluid in the lower chamber acts against the lower piston area resulting in an unbalanced upward force on the valve.

Utilizing the present invention, the diameter of the upper piston can be made larger in diameter than prior art pistons where the lower piston diameter is then designed to yield the desired differential cross-sectional area between the upper piston and the lower piston. The differential area determines the level of the force generated by the actuator at a given fluid pressure, and according to the present invention is independent of engine valve stem diameter. In an alternate embodiment, the top and bottom pistons are made as a one piece unit for ease of assembly and improved sealing.

One provision of the present invention is to provide an actuator powered by a high pressure fluid to open and close an engine valve.

Another provision of the present invention is to provide an actuator powered by a high pressure fluid to open and close an engine valve where an upper piston and an adjacent lower piston provide the opening and closing forces.

Another provision of the present invention is to provide a hydraulic actuator to open and close an engine valve where an upper piston and an adjacent lower piston provide the opening and closing forces.

Still another provision of the present invention is to utilize an upper piston and an adjacent concentric lower piston in a fluid powered engine valve actuator to provide the opening and closing forces on an engine valve.

DETAILED DESCRIPTION OF THE PREFERRED EMBODIMENT

Figure 1:
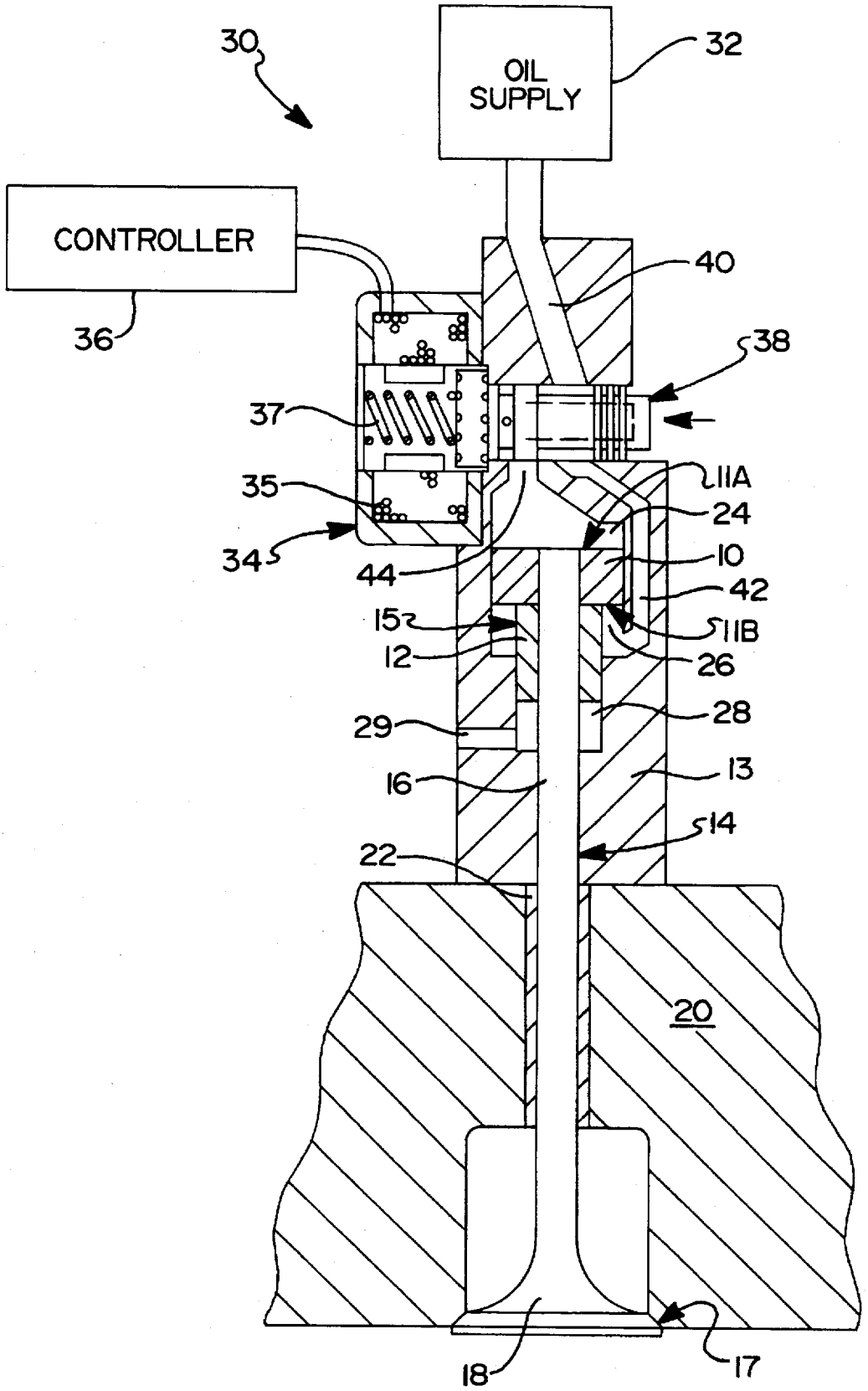
FIG. 1 is a cross-sectional view of an engine valve actuator incorporating the present invention.

For purposes of promoting the understanding of the principles of the invention, reference will now be made to the embodiment illustrated in the drawings and specific language will be used to describe the same. It will nevertheless be understood that no limitation on the scope of the invention is thereby intended, such alterations and further modifications in the illustrated device, and such further applications of the principles of the invention as illustrated therein being contemplated as would normally occur to one skilled in the art to which the invention relates.

Certain terminology will be used in the following description for convenience in reference only and will not be limiting. The terms "rightward" and "leftward" will refer to directions in the drawings in connection with which the terminology is used. The terms "inwardly" and "outwardly" will refer to directions toward and away from respectively, the geometric center of the apparatus. The terms "upward" and "downward" will refer to directions as taken in the drawings in connection with which the terminology is used. All foregoing terms mentioned above include the normal derivatives and equivalents thereof.

Now referring to FIG. 1, a cross-sectional view of an engine valve actuator incorporating the present invention is shown. The engine valve actuator 30 is powered by a high pressure oil supply 32 which can be a hydraulic pump driven by the engine (not shown). A solenoid actuator 34 is electrically controlled by controller 36 which sends electrical power to the coil 35 when the engine valve 14 is to be opened (causing the valve head 18 to be separated from the valve seat 17). The solenoid actuator 34 moves the control valve 38 to the left thereby allowing high pressure oil to flow through oil passageways 40 and 44 into the upper chamber 24. A more detailed disclosure of the operation of the valve actuator 30 can be understood by examining U.S. Pat. No. 5,507,316. The return spring 37 forces the control valve 38 to the right when the solenoid actuator is deactivated thereby allowing the upper chamber 24 to drain through the control valve 38. The high pressure oil in the lower chamber 26 then forces the engine valve 14 upward. The lower chamber 26 is maintained at the pressure of the oil supply 32 through flow communication through oil passageways 40 and 42. The drain chamber 28 is held at a very low pressure through drain passageway 29.

Using the present invention, the diameter of the upper piston 10 can be selected independent of the diameter of the valve stem and then the diameter of the lower piston 12 is determined by the desired differential cross-sectional area between the upper piston 10 and the lower piston 12. The upper piston 10 and the lower piston 12 can be fabricated from a variety of materials such as aluminum, steel, ceramic or titanium, etc. For example, if a differential area of 1.7 is desirable from actuation force and design standpoint, then a selected diameter for the upper piston 10 of 20 mm would require a diameter for the lower piston 12 of 11.8 mm. When using the prior art, a differential area of 1.7 would set the diameter of the upper piston 10 at 10.2 mm based on a valve stem 6 having a 6 mm diameter. Thus, the present invention permits design flexibility for the sizing of flow passageways 40, 42 and of the control valve 38 and designing for a given closing force by allowing the diameter of the upper piston 10 to be increased independent of the diameter of the valve stem 14. In general the cross-sectional area of the upper piston 10 is greater than the cross-sectional area of the lower piston 12 while the cross-sectional area of the lower piston 12 is greater than the cross-sectional area of the valve stem 16. The differential between the cross-sectional area of the upper piston 10 and the lower piston 12 determines the force generated by a given fluid pressure in the upper chamber 24 and in the lower chamber 26. The upper chamber 24 is defined by the top first side 11A of the upper piston 10 and the actuator housing 13. Preferably, the lower chamber 26 is defined by the bottom side 11B of the upper piston 10 and the outer peripheral surface 15 of the lower piston 12 and the actuator housing 13. The lower piston 12 seals against the upper piston 10 to prevent penetration of the high pressure fluid between the bottom side 11B of the upper piston 10 and the lower piston 15 and resultant flow losses.

Figure 2:
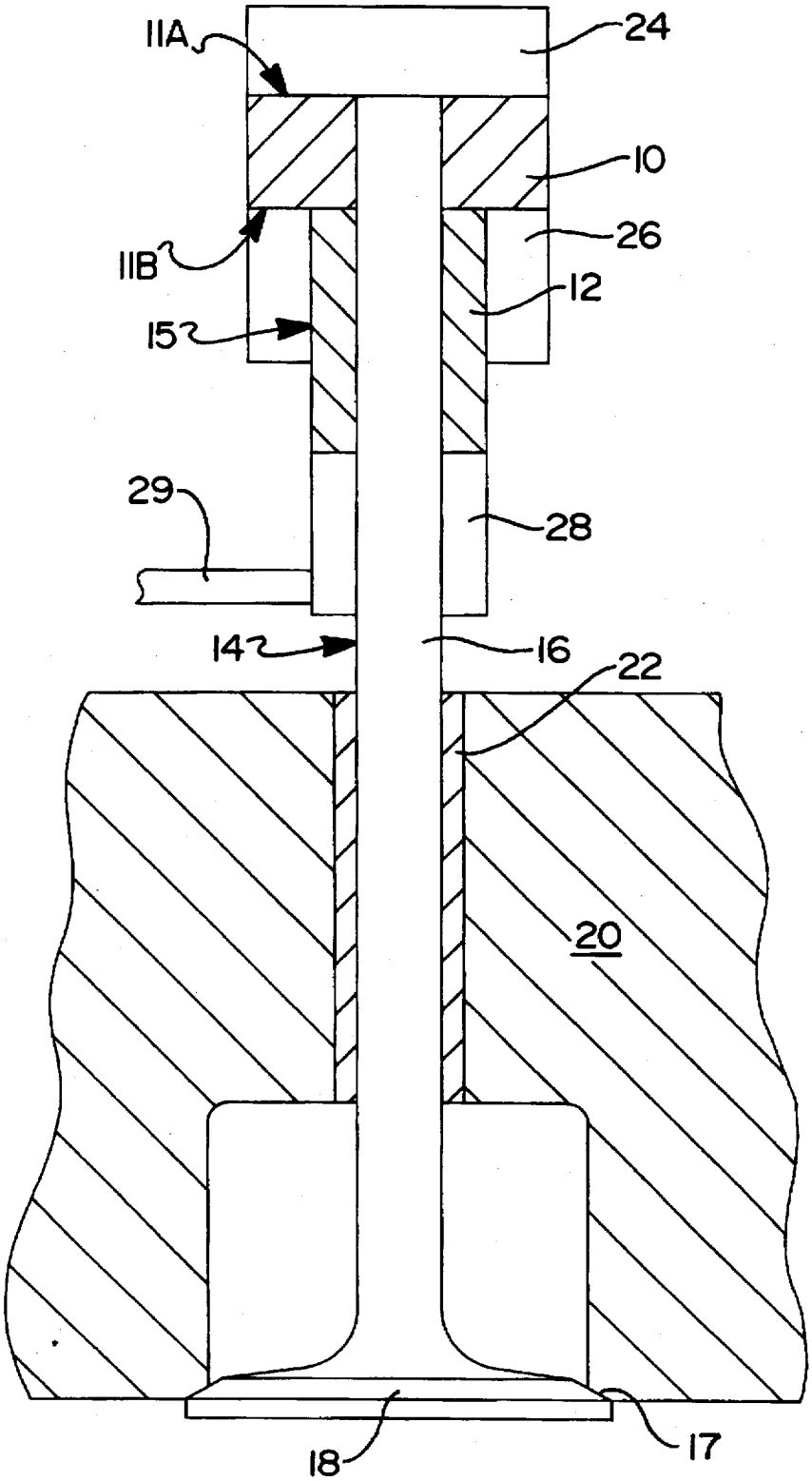
FIG. 2 is a partial cross-sectional view of the present invention.

Now referring to FIG. 2 of the drawings, a partial cross-sectional view of the present invention is shown. An upper piston 10 is positioned directly above and contacts a lower piston 12 both of which are secured to an engine valve 14 specifically on the upper portion of the valve stem 16. The upper piston 10 and the lower piston 12 and the valve stem 16 all have a circular cross-section and am concentric one with the other. The upper piston 10 and the lower piston 12 can be separate pieces or they can be formed as one piece and then attached to the valve stem 16. Valve head 18 seals and opens with respect to the valve seat 17 as part of the cylinder head 20. The valve stem 16 moves upward and downward in the valve guide 22 according to high pressure fluid flow in and out of an upper chamber 24 where the outer peripheral surface of the upper piston 10 is in close proximity to the walls of the upper chamber 24 so as to minimize leakage of the fluid. High pressure fluid continuously resides in a lower chamber 26. The outer peripheral surface of the lower piston 12 is in close proximity to the wall of the lower chamber 26 so as to minimize leakage of the fluid. The drain chamber 28 is maintained at a very low pressure to facilitate movement of the upper and lower pistons 10, 12 downward through drain passageway 29 (see FIG. 1).

The cross-sectional area of the upper piston 10 is greater than the cross-sectional area of the lower piston 12 while the cross-sectional area of the lower piston 12 is greater than the cross-sectional area of the valve stem 16. The differential between the cross-sectional area of the upper piston 10 and the lower piston 12 determines the force generated by a given fluid pressure in the upper chamber 24 and in the lower chamber 26. The upper chamber 24 is defined by the top first side 11A of the upper piston 10 and the actuator housing 13. The lower chamber 26 is defined by the bottom side 11B of the upper piston 10 and the outer peripheral surface 15 of the lower piston 12 and the actuator housing 13.

This invention has been described in great detail, sufficient to enable one skilled in the art to make and use the same. Various alterations and modifications of the invention will occur to those skilled in the art upon a reading and understanding of the foregoing specification, and it is intended to include all such alterations and modifications as part of the invention, insofar as they come within the scope of the appended claims.

I claim:

1. An engine valve actuator comprising:

an engine valve having a valve stem;

an actuator housing surrounding a portion of said valve stem;

a supply of high pressure fluid;

electronic control means;

a control valve operated in response to said control means mounted in said actuator housing for controlling the flow of said supply of high pressure fluid;

an upper piston having a first side and a second side attached to said valve stem;

a lower piston having a first side and a second side and an outer surface attached to said valve stem, said first side of said lower piston contacting and sealing against said second side of said upper piston;

an upper chamber whose volume is defined by said first side of said upper piston and said actuator housing which increases as said engine valve opens and decreases as said engine valve closes, said upper piston moving within said upper chamber volume in response to the flow of said high pressure fluid controlled by said control valve;

a lower chamber defined by said second side of said upper piston and said actuator housing and said peripheral surface of said lower piston;

where high pressure fluid is present in said lower chamber;

and where said control valve allows said high pressure fluid to flow into said upper chamber upon activation by said control means.

2. The engine valve actuator of claim 1, wherein said control valve is displaced by a solenoid actuator connected to said control means.

3. The engine valve actuator of claim 1, wherein said upper piston and said lower piston are formed as one assembly.

4. The engine valve actuator of claim 1, further comprising a drain chamber defined by said second side of said lower piston and said actuator housing and said engine valve stem, said drain chamber being vented to a source of low pressure relative to said high pressure fluid.

5. The engine valve actuator of claim 1, wherein said upper piston and said lower piston are formed as one assembly and sealingly attached to said valve stem thereby preventing said high pressure fluid from flowing from said lower chamber to said upper chamber along said valve stem.

* * * * *